US005755436A

United States Patent [19]

Reist

[11] Patent Number: 5,755,436

[45] Date of Patent: May 26, 1998

[54] CLAMP FOR SHEET-LIKE ARTICLES

[76] Inventor: Walter Reist, Schonenbergstrasse, CH-8340 Hinwil, Switzerland

[21] Appl. No.: 720,703

[22] Filed: Oct. 2, 1996

[30] Foreign Application Priority Data

Oct. 3, 1995 [CH] Switzerland ..... 02786/95
Aug. 21, 1996 [EP] European Pat. Off. ..... 96113358

[51] Int. Cl.[6] ..... G65H 29/04

[52] U.S. Cl. ..... 271/204; 198/803.4; 294/104; 294/110.2

[58] Field of Search ..... 271/85, 204–205; 198/803.9; 294/104, 110.2, 116

[56] References Cited

U.S. PATENT DOCUMENTS

| | | | |
|---|---|---|---|
| 2,739,548 | 3/1956 | Poll | 198/803.9 |
| 4,307,801 | 12/1981 | Hänsch . | |
| 4,381,056 | 4/1983 | Eberle . | |
| 4,638,906 | 1/1987 | Winiasz | 198/803.9 |
| 4,921,294 | 5/1990 | Klopfenstein | 271/204 |
| 4,982,834 | 1/1991 | Jacobsen | 271/85 |
| 5,356,128 | 10/1994 | Eberle et al. | 271/207 |
| 5,388,820 | 2/1995 | Eberle et al. . | |

FOREIGN PATENT DOCUMENTS

A-636824 6/1983 Switzerland .

*Primary Examiner*—H. Grant Skaggs
*Attorney, Agent, or Firm*—Bell Seltzer Intellectual Property Law Group of Alston & Bird LLP

[57] ABSTRACT

A clamp for retaining sheet-like articles having clamp jaws pivotably mounted on a spindle and retained in a clamping position by a closure device. The closure device is formed by carrying arms which have a clamping body. The two clamping bodies are located in a latch-in depression formed on the outer side of the clamp jaws and exert a closure force on the two clamp jaws. By virtue of the closure device being pivoted up from the clamping position into a release position, the clamp jaws are released and pivot into the release position.

20 Claims, 5 Drawing Sheets

CLAMP FOR SHEET-LIKE ARTICLES

FIELD OF THE INVENTION

The present invention relates to a clamp for retaining sheet-like articles, in particular flexible articles such as single-sheet and multi-sheet printed products.

BACKGROUND OF THE INVENTION

A prior art clamp of this type is exemplified by CH-A-636 824 and the corresponding U.S. Pat. No. 4,307,801. This clamp has two clamp jaws which are mounted in a retaining means such that they can be pivoted about a common spindle. A closure spring moves the clamp jaws in the closure direction and retains them in a clamping position. To open the clamp, one clamp jaw is pivoted away from the other clamp jaw, counter to the action of the closure spring, by the action of force on an opening lever which is fixedly connected to the first-mentioned clamp jaw. For the clamp to open, the force of the closure spring thus has to be overcome.

SUMMARY OF THE INVENTION

An object of the present invention is to provide a clamp wherein the clamping jaws, in their clamping position, clamp the gripped article securely, while permitting the clamp to be opened in a simple manner.

This object is achieved by a clamp having two clamp jaws which pivot relative to one another so as to grip the article being processed. A closure device applies a closure force to the jaws. The closure device assumes a release position wherein the jaws are released and a closure position wherein the closure force is applied to the jaws.

In its closure position, the closure device ensures that the clamp jaws are pushed against one another to achieve a sufficiently strong clamping action. On displacement of the closure device into the release position, the closure forces acting on the clamp jaws are eliminated and the clamp jaws can move away from one another and release the gripped article.

The clamp according to the invention is suitable for use in a transporting apparatus for sheet-like articles in which the clamps are fitted on a drawing member, driven in circulation, and thus moved along a transporting path.

BRIEF DESCRIPTION OF THE DRAWINGS

The subject matter of the invention is explained in more detail hereinbelow with reference to the drawing, in which, purely schematically.

DETAILED DESCRIPTION OF THE PREFERRED EMBODIMENTS

Figure 1:
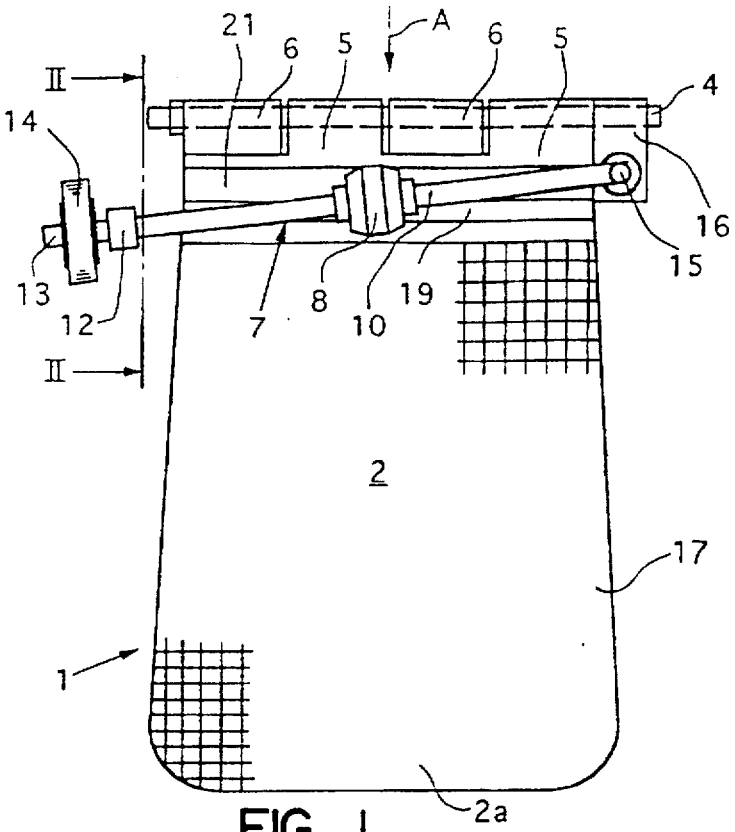
FIGS. 1 and 2 show, respectively in front view and in side view section along II—II, a clamp according to the invention in the closed state.

The construction and the mode of operation of the clamp according to the invention are explained hereinbelow with reference to FIGS. 1 to 5.

The clamp 1 has two clamp jaws 2, 3 which consist of a somewhat rigid material, for example of a suitable plastic. The two clamp jaws 2, 3 are mounted such that they can be pivoted about a common spindle 4. The clamp jaw 2 is provided with lugs 5 and the clamp jaw 3 is provided with lugs 6 for engaging around the spindle 4 and being alternately arranged in the longitudinal direction, as seen best in FIGS. 1, 3 and 5. In their clamping position shown in FIGS. 1 and 2, the clamp jaws 2, 3 are pushed against one another by means of a closure device 7. The closure device 7 is shown in its closed position in FIGS. 1 and 2 and in its released position in FIGS. 3 and 4.

The closure device 7 has two clamping bodies 8, 9 which are located opposite one another a distance "a" apart (FIG. 2) and between which the clamp jaws 2, 3 are positioned. Each clamping body 8, 9 is preferably fastened rotatably on a pliable yet rigid carrying arm 10 and 11, respectively. At one end, the two carrying arms 10, 11 are connected to one another via a connecting piece 12. A bearing bolt 13 on which a control roller 14 is mounted projects away from the connecting piece 12. This control roller may be connected rotatably or fixedly to the bearing bolt 13. At the opposite end, the carrying arms 10, 11 are fastened on a pivot pin 15 which is mounted pivotably in a bearing body 16. The latter is fitted rotatably on the spindle 4, with the result that the closure device 7 can pivot with the clamp jaws 2, 3. The carrying arms 10, 11, the connecting piece 12 and the pivot pin 15 form a bracket.

On the outer sides 17, 18 of the clamp jaws 2, 3, at the end adjacent the spindle 4, are latch-in depressions 19, 20 for the clamping bodies 8, 9. The latch-in depressions 19, 20 are bounded in the direction of the spindle 4 by a latching nose 21 or 22, respectively, in the form of a bead. The distance "b" (FIG. 2) between the outermost locations of the latching noses 21, 22 is greater than the distance "a" between the clamping bodies 8, 9.

Figure 2:
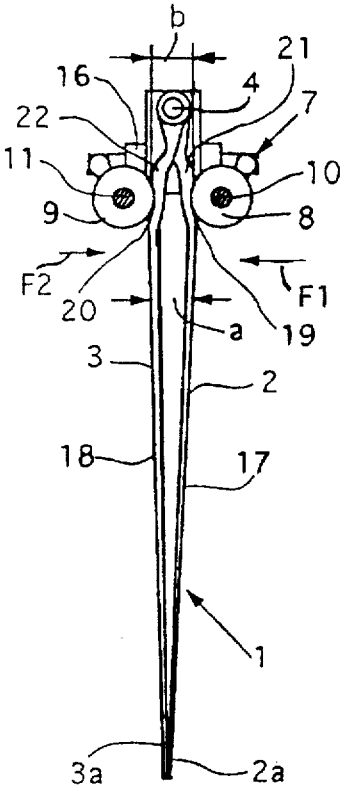
Figure 3:
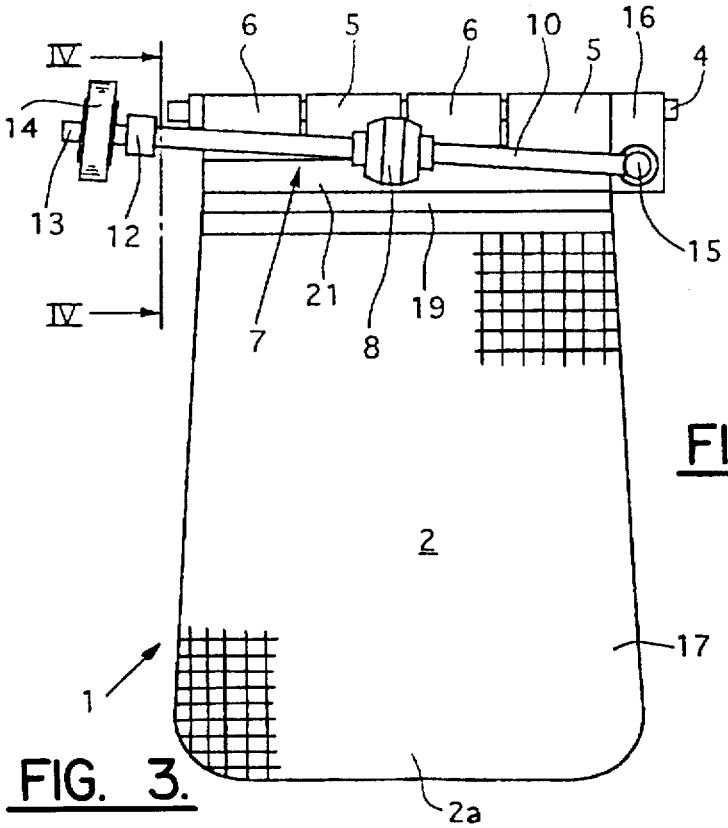
FIGS. 3 and 4 show, in an illustration corresponding to FIGS. 1 and 2, the clamp shown in FIGS. 1 and 2 in the open state.
Figure 4:
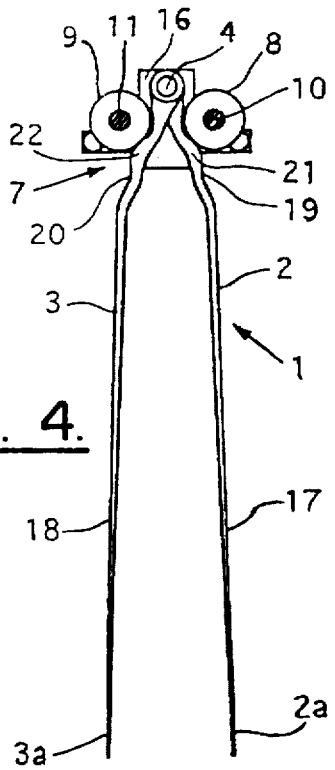
Figure 5:
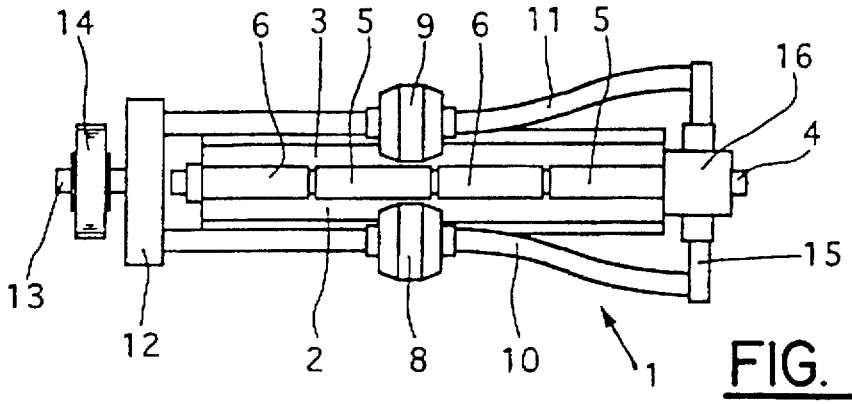
FIG. 5 shows a plan view, in the direction of the arrow A in FIG. 1, of the clamp according to FIG. 1.

The method of operation of the clamp 1 is as follows:

If, as is shown in FIGS. 3 and 4, the closure device 7 is pivoted up into the release position, in which the clamping bodies 8, 9 are located on the side opposite the latch-in depressions 19, 20, in relation to the latching noses 21, 22, then the clamp jaws 2, 3 can pivot away from one another around the spindle 4 and assume the open or release position (FIG. 4). In this arrangement, the opening angle is determined by the two clamping bodies 8, 9. To close the clamp 1 and apply a clamping force, the closure device 7 is pivoted downwards from the release position into the closure position. This state is shown in FIGS. 1 and 2. During the pivoting into the closure position, the clamping bodies 8, 9 must first run over the latching noses 21, 22, with the simultaneous application of a certain amount of force, whereupon the clamping bodies then engage into the latch-in depressions 19, 20.

As FIG. 2 shows, the clamp jaws, 2, 3 are designed such that their ends 2*a*, 3*a* are in contact, while the clamp jaws 2, 3 are spaced apart from one another in the region of the latch-in depressions. In other words, the clamp jaws 2, 3 are curved slightly from the spindle 4 to the ends 2a, 3a. In the clamping position of the closure device 7, each of the two clamping bodies 8, 9, arranged at a fixed distance a apart from one another, exerts a closure force F1 or F2 (FIG. 2) on the associated clamp jaw 2, 3, respectively. The two closure forces F1, F2 act counter to one another on the outer side 17 or 18 of the corresponding clamp jaw 2 or 3, respectively.

Figure 6:
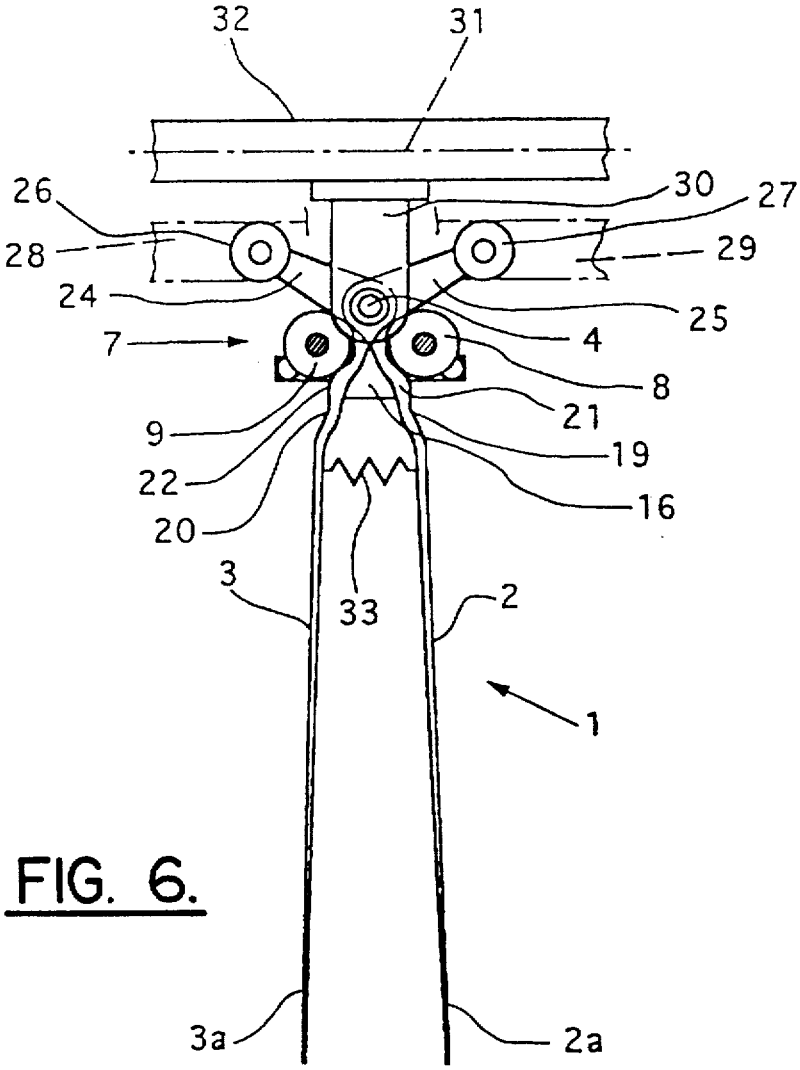
FIG. 6 shows, in an illustration corresponding to FIG. 4, a second embodiment of a clamp according to the invention.

In an illustration corresponding to FIG. 4, FIG. 6 shows another embodiment of a clamp 1 in the open position. This embodiment of the clamp 1 only differs from that according to FIGS. 1 to 5 in that each clamp jaw 2, 3 is connected to an actuating lever, specifically the clamp jaw 2 is connected to an actuating lever 24 and the clamp jaw 3 is connected to an actuating lever 25. The actuating levers 24, 25 are mounted pivotably on the spindle 4 and bear a control roller 26 or 27, respectively, at their free end. Control curves 28 or 29, which act on the associated control rollers 26 or 27, respectively, are indicated by chain-dotted lines in FIG. 6. The pivot movements of the clamp jaws 2 and 3 from the open position into the clamping position and, when the closure device 7 is located in the release position, also from the clamping position into the open position are controlled via said actuating levers 24, 25 and the control rollers 26, 27 interacting with the control guides 28, 29. When the clamp 1 is closed, i.e. when the clamp jaws 2, 3 are locked in the clamping position, the clamp 1 may be pivoted as a unit around the spindle 4 by means of the actuating levers 24, 25. It is, of course, possible to control the clamp jaws 2, 3 individually by means of the associated actuating levers 24, 25.

FIG. 6 further indicates that the clamp 1, whether it be designed as shown in FIG. 6 or as shown in FIGS. 1 to 5, may be fastened, via a mount 30, on a drawing member 31 (indicated only schematically in FIG. 6) which is guided in a guide channel 32 and is driven in circulation. In this way, the clamps 1 form part of a transporting apparatus, as will be explained in more detail with reference to FIG. 7.

For the purpose of pivoting the clamp jaws 2, 3, once they have been released by the closure device 7, from the clamping position into the open position, use a compression spring 33 is arranged between the clamp jaws 2, 3 and is indicated schematically in FIG. 6. The clamp jaws 2, 3 are retained in their open position by the compression spring 33. Said compression spring 33 may also be used for a clamp 1 as is shown in FIGS. 1–5.

Figure 7:
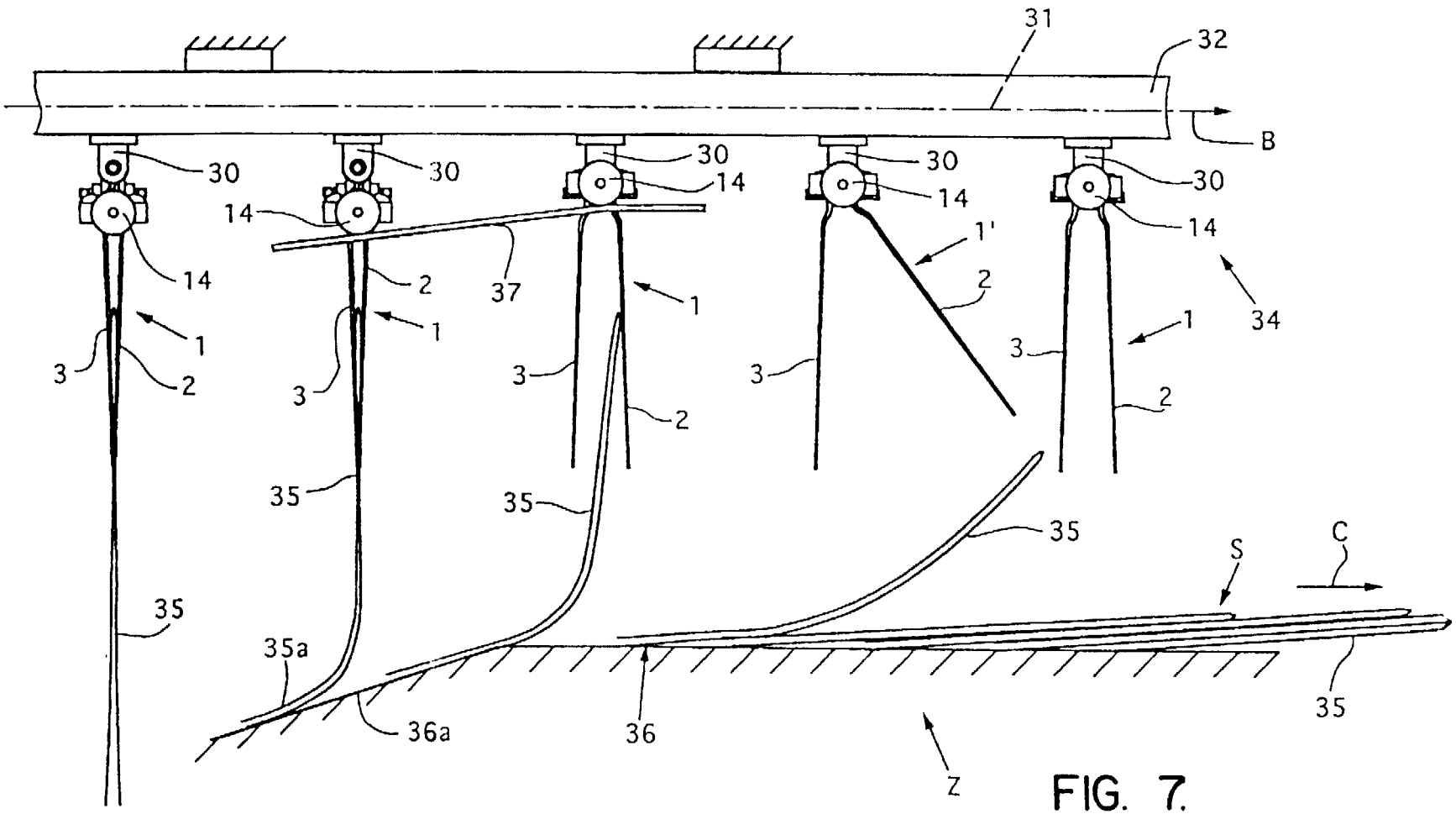
FIG. 7 shows a side view of a transporting apparatus for printed products which is equipped with clamps according to the present invention.

A section of the abovementioned transporting apparatus 34 is shown in FIG. 7. Clamps 1 are fastened, by means of the mounts 30, at regular intervals on the drawing member 31, which is driven in the direction of the arrow B. The transporting apparatus 34 serves for conveying printed products 35 (e.g. folded printed sheets) to a discharge location Z. Located at the discharge location Z is a set-down table 36, which has an upwardly sloping guide section 36a arranged upstream of it.

As can be seen from FIG. 7, the printed products 35 secured by the closed clamps 1 are guided in a suspended manner to the discharge location Z. The lower end regions 35a of the printed products 35 run onto the upwardly sloping guide section 36a, which results in the printed products 35 being forced into a rearwardly inclined oblique position. Arranged above the set-down table 36 is a stationary opening guide 37 which slopes upwards, as seen in the conveying direction B. The control rollers 14 of the closure devices 7 run onto said opening guide 37, which results in the closure device 7 being pivoted up out of the closure position into the release position. Consequently, the clamp jaws 2, 3 are released and can move away from one another. The printed products 35 drop downwards and, in the process, deposit themselves on the preceding printed product 35 in the manner of roofing tiles. The imbricated formation S thus formed on the set-down table 36 is guided away in the direction of the arrow C by means of a removal conveyor (not shown in any more detail). The open clamps 1 run on, in the suspended position, to a receiving station (not shown), in which they receive a printed product 35 again. In this case, the closure device 7 is pivoted back by means of a guide or the like, from the release position into the closure position as soon as the printed product 35 which is to be transported away has been pushed in between the clamp jaws 2, 3.

Modifications in the design of the clamps 1 may also be explained with reference to FIG. 7. If the bearing body 16 is fastened on the mount 30, with the result that the closure device 7 can no longer rotate on the spindle 4, this determines the position of the clamps 1 both in the open state and in the closed state. In this determined position, the clamps 1 may extend in the vertical direction or may be positioned at an angle with respect to the vertical.

Instead of the two clamp jaws 2 and 3 being mounted pivotably on the spindle 4, as has been described, it is also possible for one clamp jaw 2 or 3 to be fixed in position and only the other clamp jaw to be mounted pivotably. Such an embodiment is illustrated in FIG. 7 by the clamp designated by 1'. In this case, the clamp jaw 3 assumes a fixed position, while the other clamp jaw 2 is mounted pivotably.

Figure 8:
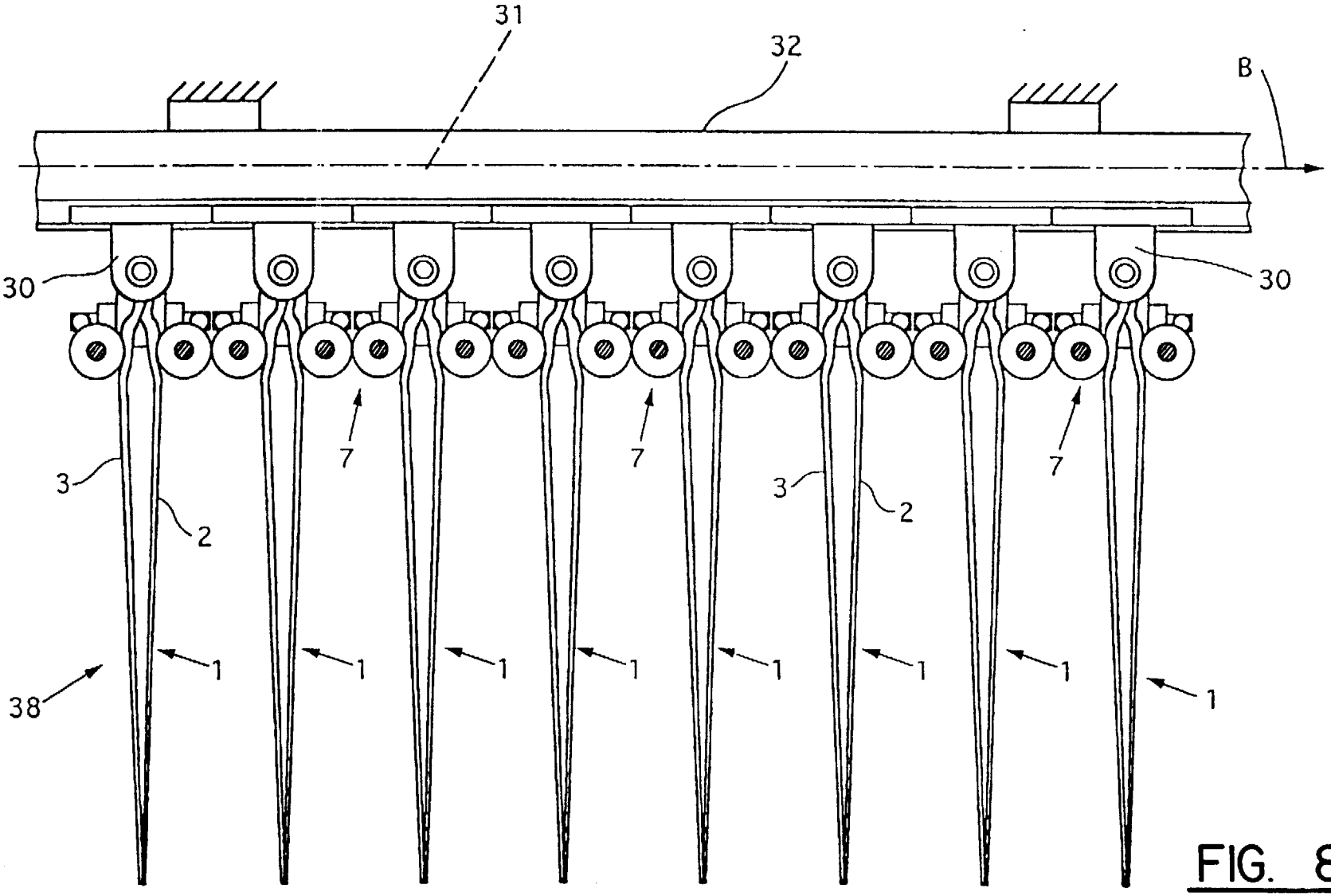
FIG. 8 shows a side view of a buffer station with a number of clamps according to the present invention which have been pushed together.

FIG. 8, shows an alternative embodiment of FIG. 2 illustrating a buffer station 38 in which a number of closed clamps 1 have been pushed together such that they abut against one another. The printed products secured by the clamps 1 are not shown. For such buffering of the clamps 1, the latter have to be connected releasably to the drawing member 31. The clamps 1 clamped on the drawing member 31 are brought to the buffer station 38. When contact is made with the preceding clamp, the connection to the drawing member 31 is then released. For the purpose of emptying the buffer station 38, the clamps 1 are then coupled again one after the other to the drawing member 31, which may be driven either in the conveying direction B or in the direction counter to this. It can be seen from FIG. 8 that, on account of the design-related small width of the clamps 1, the clamps take up only a small amount of space in the buffer station 38.

Figure 9:
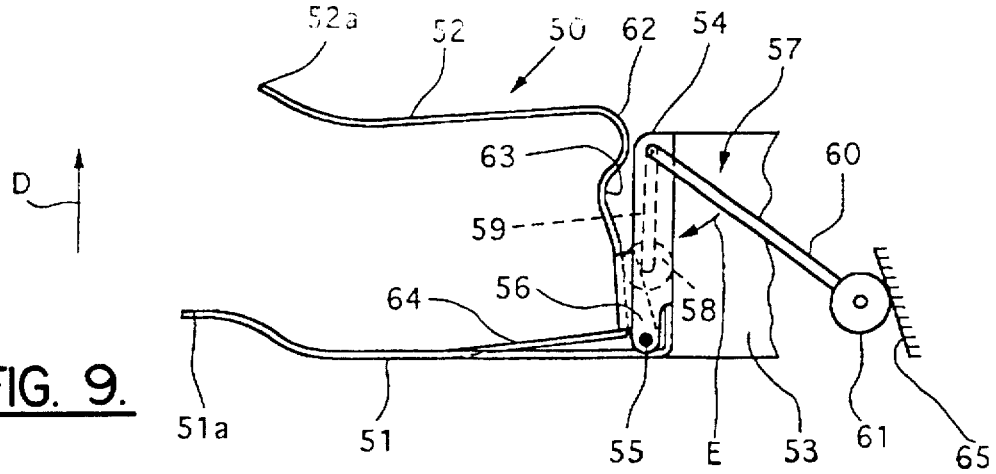
FIGS. 9 and 10 show side views of a third embodiment of a clamp according to the present invention in the open state and in the closed state, respectively.
Figure 10:
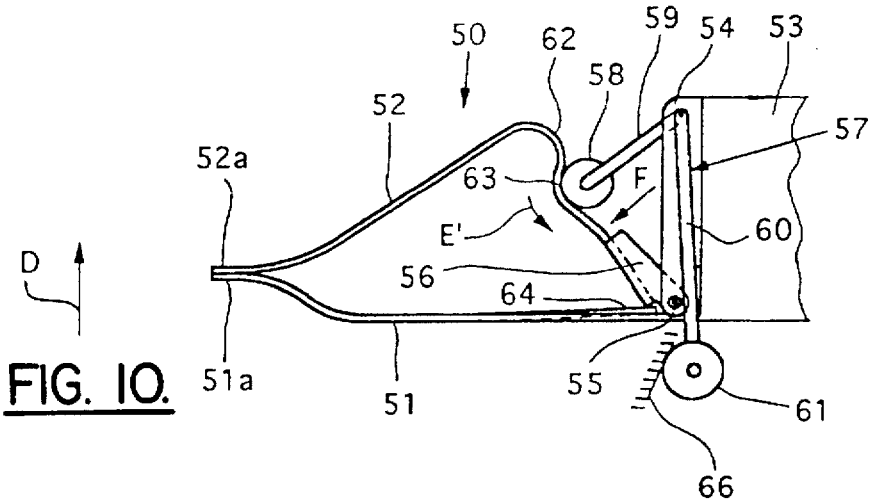
Figure 11:
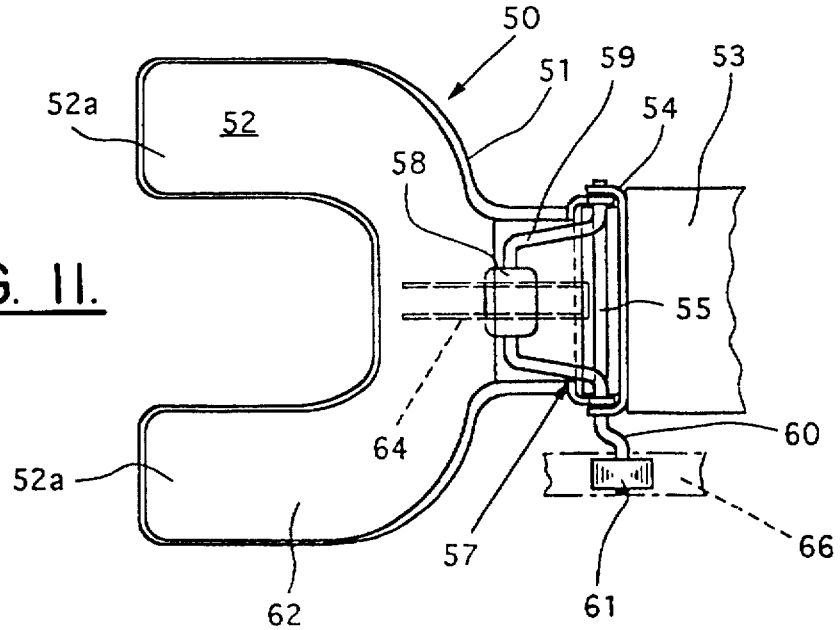
FIG. 11 shows a plan view of the clamp according to FIGS. 9 and 10.

The third embodiment, shown in side view and plan view in FIGS. 9–11, of a clamp 50 according to the invention likewise has two clamp jaws 51, 52, which preferably consist of a resilient material, e.g. of spring steel. One clamp jaw 51 is fastened on a clamp body 53 and is thus fixed. A mount 54, in which a spindle 55 is retained, is fitted on the clamp body 53. The movable clamp jaw 52 is mounted pivotably on said spindle 55. For this purpose, the clamp jaw 52 has two lateral, bent-up lugs 56 through which the spindle 55 passes. In its clamping position shown in FIG. 10, the movable clamp jaw 52 is pushed against the fixed clamp jaw 51 by means of a closure device 57. The closure device 57 is shown in its closure position in FIG. 10 and in its release position in FIG. 9. FIG. 9 shows the clamp 50 in the open position.

The closure device 57 has a clamping roller 58 which is preferably arranged rotatably on a carrying bracket 59. Connected to the carrying bracket 59 is an actuating lever 60, which has a control roller 61 at its free end. On its outer side 62, the movable clamp jaw 52 is provided with a latch-in depression 63 for the clamping roller 58. The resilient tongue 64 is formed in the fixed clamp jaw 51 by punching and, in its released position shown in FIG. 9, projects from the clamp jaw 51 towards the movable clamp jaw 52. The resilient tongue 64 acts on the movable clamp jaw 52 by means of its free end and holds said movable clamp jaw open.

The mode of operation of the clamp 50 is as follows:

If the closure device 57 is in the release position shown in FIG. 9, then the movable clamp jaw 52 can be pivoted away from the fixed clamp jaw 51 by the resilient tongue 64. The clamp 50 is located in the open position. If, when the clamp 50 is open, the control roller 61 runs onto the closure guide 65 (illustrated only schematically in FIG. 9) during the movement of said clamp 50 in the direction of the arrow D, then the closure device 57 is pivoted from the release position into the closure position. In other words, for the purpose of closing the open clamp 50, the carrying bracket 59, with the clamping roller 58, is pivoted in the direction of the arrow E (FIG. 9). During this pivot movement, the clamping roller 58 acting on the outer side 62 of the clamp jaw 52 pushes the movable clamp jaw 52 against the fixed clamp jaw 51. When the clamp 50 is in the clamping position shown in FIG. 10, the clamping roller 58 latches into the latch-in depression 63. In this clamping position of the clamp 50, the two clamp jaws 51, 52 clamp, by means of their ends 51*a* and 52*a*, the printed product which is to be transported. In the closure position of the closure device 57, in which position, as has been mentioned, the clamping roller 58 engages into the latch-in depression 63, the resilient tongue 64 is subjected to stressing. In its closure position, the closure device 57 assumes a stable position, which means that no additional means acting on the closure device 57 from the outside are necessary for the purpose of locking the two clamp jaws 51, 52 in the clamping position.

The closed clamp 50 is opened, by use of an opening guide 66 (illustrated only schematically in FIG. 10) onto which the control roller 61 runs. As a result, the carrying bracket 59, with the clamping roller 58, is pivoted back into the release position in the direction of the arrow F. The movable clamp jaw 52 is pushed away from the fixed clamp jaw 51 by the resilient tongue 64.

The clamp 1 or 50 according to the invention has the further advantage that it is of a comparatively simple and lightweight design. Locking of the clamp jaws 2, 3 or 51, 52 in their clamping position is effected quickly, and without an overly great amount of force being expended, by a brief movement of the closure device 7 or 57 from the release position into the closure position. The same also applies to the opening operation, of course.

Instead of the closure device 7 being pivoted from the release position into the closure position and vice versa, it is also possible to design the closure device 7 such that it can be displaced from the closure position into the release position and vice versa by way of a translatory movement.

The clamp 1 or 50 according to the invention may also be used for retaining flexible articles other than printed products as well as rigid sheet-like articles, e.g. those consisting of cardboard.

That which is claimed:

1. A clamp for retaining sheet-like articles comprising two clamp jaws which are pivotally mounted relative to one another to assume a clamping position and an open position, wherein, in the clamping position, the clamp jaws grip at least one of the sheet-like articles, each clamp jaw having an inner side facing the other clamp jaw and an outer side being remote from the other clamp jaw; a closure device connected to the clamp jaws, said closure device being movable between a release position and a closure position and in the closure position applies a closure force to an outer side of at least one of the clamp jaws for pushing the clamp jaws against one another in the clamping position, said closure device, in its release position permitting the clamp laws to assume their open position; and means provided on at least one of said clamp jaws for releasably latching the closure device in its closures position.

2. The clamp according to claim 1 wherein the closure device comprises two clamping elements located opposite one another a predetermined distance, each of which, when the closure device is in the closure position, rests against the outer sides of the clamp jaws, and applies the closure force to a respective clamp jaw.

3. The clamp according to claim 2 wherein the clamping elements are retained on a bracket which is pivoted between the closure position and the release position.

4. The clamp according to claim 3 wherein the bracket carries a control roller which, when contacted by an opening element, causes movement of the bracket from the clamping to the open position.

5. The clamp according to claim 3 wherein the two clamp jaws are connected to one another in an articulated manner by means of a spindle on which the bracket is mounted.

6. The clamp according to claim 5 wherein the clamping elements are positioned a greater distance below the spindle in the closure position of the closure device than when the closure device is in the release position.

7. The clamp according to claim 3 wherein the bracket is secured against pivoting together with the clamp jaws at the closure position.

8. The clamp according to claim 3 wherein the bracket is rotatably mounted on a spindle such that it can pivot along with the clamp jaws.

9. The clamp according to claim 1 wherein the clamp jaws each comprise a latch-in depression on the outer side thereof for receiving the clamping elements when the closure device is in the closure position.

10. The clamp according to claim 1 wherein at least one of said clamp jaws is pivotably mounted on a spindle and the pivotable clamping jaw is connected to an actuating lever which has mounted thereon a control roller, which interacts with a control guide to pivoted the at least one pivotable clamp jaw.

11. The clamp according to claim 10 wherein a bracket is rotatably mounted on the spindle such that it can pivot along with the clamp jaws.

12. The clamp according to claim 1 further comprising a spring element which acts on the clamp jaws for pushing the clamp jaws into the open position.

13. The clamp according to claim 1 wherein at least one clamp jaw is fastened on a retaining part and the other clamp jaw is pivotably mounted wherein the closure device acts against the pivotable clamp jaw on the outer side remote from the fastened clamp jaw, and in the closure position, applies the closure force on said pivotable clamp jaw.

14. The clamp according to claim 13 wherein the closure device has a clamping element which is retained on a carrying element which can be moved back and forth between the release position and the closure position and is connected to the retaining part.

15. The clamp according to claim 14 wherein the clamping element engages into a latch-in depression which is formed on an outer side of the pivotable clamping jaw in the closure position of the closure device.

16. The clamp according to claim 14 wherein the carrying element is connected to an actuating lever which is provided with a control roller arranged to interact with control guides for pivoting the carrying element between the closure position and release position.

17. The clamp according to claim 13 further comprising a spring element which is arranged to act on the pivotable clamp jaw and is intended to push the pivotable clamp jaw into its open position when the closure device is located in the release position.

18. The clamp according to claim 1 wherein said closure device is mounted for pivotal movement between the release position and the closure position.

19. A transporting apparatus for sheet-like articles guided along a transporting path comprising a drawing member having a plurality of clamps arranged at intervals thereon which is driven, each clamp comprising two clamp jaws which are pivotally mounted relative to one another to assume a clamping position and an open position, wherein, in the clamping position, the clamp jaws grip at least one of the sheet-like articles, each clamp jaw having an inner side facing the other clamp jaw and an outer side being remote from the other clamp jaw; a closure device connected to the clamp jaws, said closure device being movable between a release position and a closure position and in the closure position applies a closure force to an outer side of at least one of the clamp jaws to push the clamp jaws against one another, said closure device, in its release position permitting the clamp jaws to assume their open position; and means provided on at least one of said clamp jaws for releasably latching the closure device in its closure position.

20. The clamp according to claim 19 wherein said closure device is mounted for pivotal movement between the release position and the closure position.

* * * * *